United States Patent [19]

Kittel et al.

[11] Patent Number: 4,725,155

[45] Date of Patent: Feb. 16, 1988

[54] RIBBON CARTRIDGE FOR A TYPEWRITER OR SIMILAR OFFICE MACHINE

[75] Inventors: Arthur Kittel, Wilhelmshaven; Dieter Hellebrandt, Schortens, both of Fed. Rep. of Germany

[73] Assignee: Olympia Werke AG, Wilhelmshaven, Fed. Rep. of Germany

[21] Appl. No.: 780,425

[22] Filed: Sep. 26, 1985

[30] Foreign Application Priority Data

Oct. 25, 1984 [DE] Fed. Rep. of Germany ..... 3439089

[51] Int. Cl.[4] ..... B41J 32/00

[52] U.S. Cl. ..... 400/208; 400/228

[58] Field of Search ..... 400/207, 208, 208.1, 400/234, 228, 235, 235.1, 236, 236.2

[56] References Cited

U.S. PATENT DOCUMENTS

| | | | |
|---|---|---|---|
| 4,299,504 | 11/1981 | Benz et al. | 400/208 |
| 4,408,913 | 10/1983 | Frechette | 400/234 X |
| 4,523,868 | 6/1985 | Shadwick | 400/208 |
| 4,609,298 | 9/1986 | Shioda | 400/208 |

FOREIGN PATENT DOCUMENTS

| | | | |
|---|---|---|---|
| 0054182 | 10/1981 | European Pat. Off. | 400/208 |
| 58847 | 9/1982 | European Pat. Off. | 400/208 |
| 121971 | 10/1984 | European Pat. Off. | 400/208 |
| 122755 | 10/1984 | European Pat. Off. | 400/208 |
| 201684 | 12/1982 | Japan | 400/234 |

*Primary Examiner*—Charles A. Pearson

*Attorney, Agent, or Firm*—Wood, Herron & Evans

[57] ABSTRACT

Ribbon cartridges for typewriters or similar office machines must meet various design requirements, especially, must be easily exchangeable without soiling one's fingers, must be inexpensive to manufacture, and must dampen the noise in the printing area. To be avoided in addition is a soiling of the machine components when using the cartridge, through ribbon rub-off dropping through the holes in the bottom of the cartridge, and a smooth ribbon drive must be possible. These various problems are inventionally solved in that the cup-shaped base component of the cartridge casing features on the inside of the bottom protruding stiffening ribs which likewise serve to support the spools of the flangeless supply and take-up reels and/or prevent ribbon rub-off accruing in the cartridge casing from dropping out of the openings. The stiffening ribs required to lend the cartridge casing form stability assume likewise additional functions, such as guiding the spool of the supply and take-up reels, preventing ribbon rub-off from the cartridge casing etc. This makes the ribbon cartridge simple and inexpensive in design.

3 Claims, 6 Drawing Figures

FIG. 1
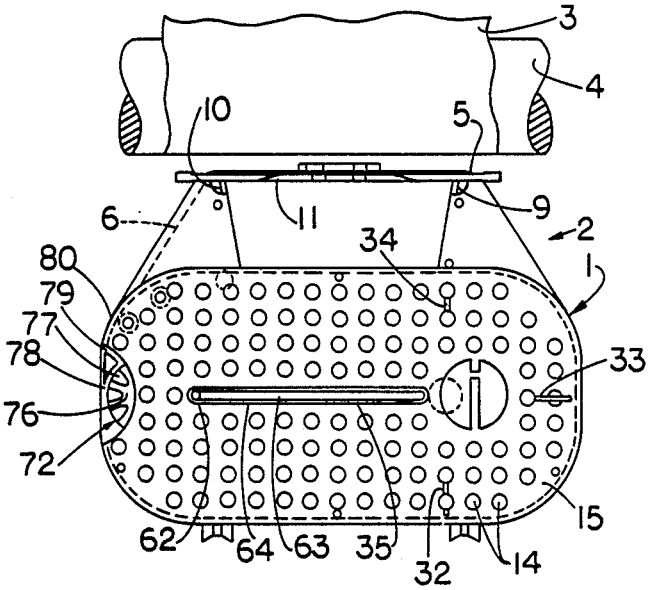
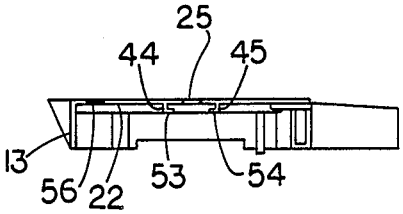
FIG. 4
FIG. 2
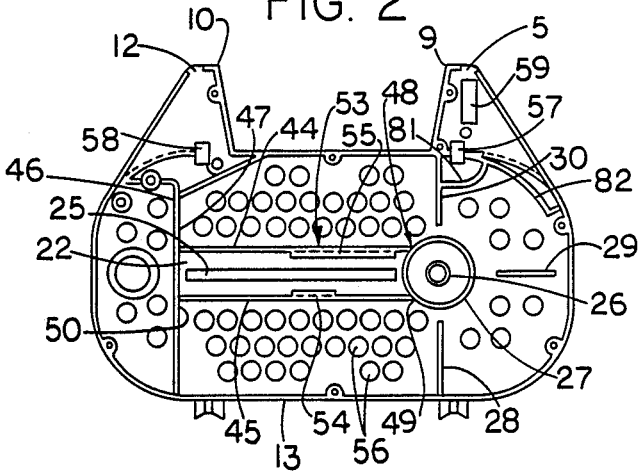
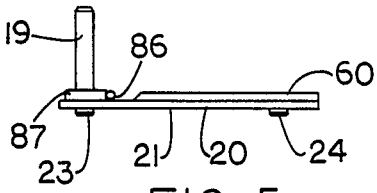
FIG. 5
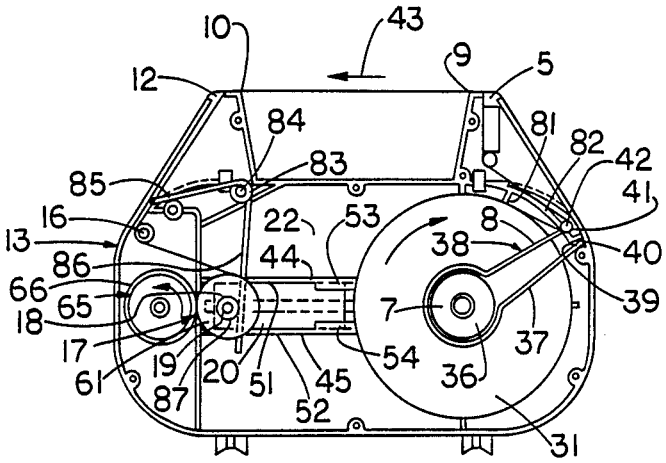
FIG. 3
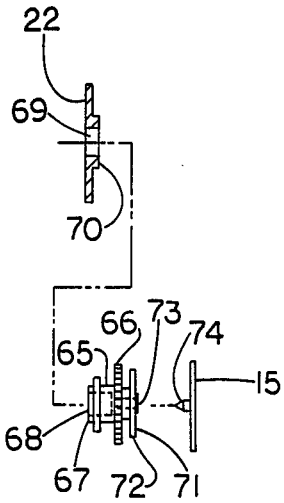
FIG. 6

RIBBON CARTRIDGE FOR A TYPEWRITER OR SIMILAR OFFICE MACHINE

BACKGROUND OF THE INVENTION

The invention concerns a ribbon cartridge for typewriters or similar office machines of the type including a ribbon arranged to be wound off a supply reel and rewound on a take-up reel and a casing having a bottom provided with a plurality of access openings for receiving elements sensing the end of the ribbon and the like.

Among the many known measures for damping the noise occurring in the vicinity of typewriters and similar printing machines, particular importance attaches to those devices through which the noise produced as the type element strikes the paper are shielded from the persons who are present in the vicinity of the machine. So-called acoustic enclosures, enclosing either the entire machine or being fitted only in the paper feed area above the platen, have proved to be especially effective. While with acoustic enclosures covering the entire machine it is possible to observe the text being typed through a sight window, access for insertion and alignment of the paper is extremely unwieldy. Therefore, acoustic enclosures of that type are not suited for offices involving frequent insertion of new sheets of stationery.

While with covers which are placed only on the paper feed and discharge in the area of the platen the paper handling is generally facilitated for the machine operator, a frequent consequence is that the noise damping cannot be accomplished with the desired effect. While with this type of acoustic covers the possibility of observing the printed text is generally satisfactory for the operator, a particular problem is the print head accessibility for changing the print wheel and the ribbon cartridge. Besides, acoustic hoods covering the platen are too expensive for low-cost correspondence typewriters. Additionally, if a machine, specifically an electric typewriter, is covered by an enclosure, a sound backup occurs within the enclosure and thus an increase of the noise level. The sound waves impinging from inside on the enclosure or flat components stimulate oscillable components to vibrations which, in turn, are the cause of the machine noise given off outwardly. For reduction of this sound backup, a ribbon cartridge has been suggested whose cup-shaped base component and cover are perforated. While the perforation reduces the sound back-up and the noise level inside the enclosure, the rub-off caused by the routing and the drive of the spent carbon ribbon drops through the holes in the bottom of the base component, soiling machine components which are located underneath. Such soiling is avoided with the ribbon cartridge according to the European patent disclosure No. 81 109 546.2 in that the sound absorption facilities of the base consist of depressions whose bottom is sealed by a membrane. Additionally, the bottom features collars surrounding the openings and additional bearing faces for the spools of the supply and take-up reels.

The problem underlying the invention is to provide a ribbon cartridge through which the sound backup inside the enclosure is effectively reduced and dropping of fines from the spent ribbon, through the openings in the base component of the cartridge casing, will be safely avoided. Additionally, the cartridge is to feature a compact design and enable a smooth drive of the supply and take-up reels, with the fines rubbing off the spent ribbon being kept low.

SUMMARY OF THE INVENTION

In accordance with the present invention, this problem is solved by providing a cartridge comprising a casing which includes the base having multi-function ribs on the inside of the carton. These ribs function to provide stiffening, to support the spools of the take-up and supply reels, and to prevent ribbon rub-off from dropping out of the cartridge openings.

The inventional ribbon cartridge gives a remarkable reduction of the noise inside the enclosure, with the machine components located underneath the ribbon cartridge, in the holding device, being no longer soiled. To increase the form stability, the base component and cover are provided with stiffening ribs, which likewise serve to support the spools of the flangeless take-up and supply reels and/or to safely prevent the ribbon fines accruing in the cartridge casing from dropping out of the openings. The internal design of the ribbon cartridge casing is greatly simplified thereby, having a favorable effect on manufacturing. For exact guidance of the supply and take-up reels, including their spools, a smoothrunning ribbon feed is accomplished and an overly amount of ribbon rub-off prevented. Further favorable designs of the inventional object derive from further subclaims and the following description.

Other advantages of the present invention will be more readily apparent from a consideration of the following detailed description of the drawings illustrating a preferred embodiment of the invention.

BRIEF DESCRIPTION OF THE DRAWINGS

FIG. 1 shows a plan view of the ribbon cartridge.

FIG. 2 shows a plan view of the inside of the cup-shaped base part of the cartridge casing.

FIG. 3 shows a plan view according to FIG. 2 with the components fitted.

FIG. 4 is a transverse cross-sectional view through the bottom member.

FIG. 5 is an elevational view of the support plate and stud.

FIG. 6 is an exploded view of the feed roll and the adjacent portions of the cases and bottom of the base member.

DESCRIPTION OF A PREFERRED EMBODIMENT

In FIG. 1, a ribbon cartridge 1 is arranged on a holding device 2 of a typewriter or similar office machine, ready for operation, said device being arranged in a fashion permitting shifting along a recording medium 3. The latter can be fed in customary fashion across a platen 4. The ribbon 6 paying out of an outlet slot 5 of the ribbon cartridge 1 unwinds from a supply reel 7, passing over a tensioning lever 8 and ribbon guides 9, 10 between the recording medium 3 and a type carrier 11. The type carrier 11, e.g., is a print wheel with a plurality of radial slots forming elastic spokes on the ends of which a character each is arranged. The setting of the print wheel 11 is effected through a not illustrated stepping motor, which is arranged also on the holder device 2. The character imprint is produced through a printing hammer which is shiftably mounted on the holding device 2 and driven, e.g., by a solenoid.

The ribbon 6 enters the cartridge casing consisting of a cup-shaped base component 13 and a cover 15 with perforations 14 by way of guide 10 and an entrance slot 12. Consisting, e.g., of a one-time carbon ribbon, the ribbon 6 is passed over a barrel-shaped reversing roll 16 and to a take-up reel 17. This take-up reel 17 is rotatably mounted with its hub 18 on a stud 19 which is permanently connected with a support plate 20. This support plate 20 rests shiftably on the bottom 22 of the base component 13, with a sliding face 21 featuring two guide studs 23, 24 which are spaced relative to each other and coordinated with a longitudinal slot 25 in the bottom 22. The supply reel 7 is rotatably mounted on a stud 26 which is arranged vertically on the bottom 22 and on which a circular stiffening rib is aligned concentrically while outside this stiffening rib 27 additional stiffening ribs 28, 29, and 20 are aligned radially. Rotatably mounted on the rounded stiffening ribs 28, 29, 30 is the spool 31 and, on the circular stiffening rib 27, the core of the take-up reel 7. Due to the slight friction, this enables a smooth rotation of the supply reel 7, safely preventing a shifting of the layers of spool 31 relative to one another. The cover 15 features correspondingly designed stiffening ribs 32, 33, 34, and 35 serving also to support the spool 31. A shifting of layers of the spool 31 of the supply reel 7, for instance when shipping the cartridge 1, is safely prevented thereby. This exact guidance of the supply reel 7 including its spool 31 results in a considerable reduction of ribbon rub-off at the guide components of the cartridge 1. The supply reel 7 features a hub 36 around which loops a tensioning lever 8 which is fashioned as a shaped wire with two free shanks 37 and 38. The shank 37 of the shaped wire is firmly anchored with its free end 39 in a recess 40 in the base component 13 of the cartridge casing while the other shank 38 is freely movable and features on its free end 41 a rotatably mounted reversing roll 42. As the ribbon 6 is pulled in arrow direction 43 according to FIG. 3, the movable shank 38 moves away from the fixed shank 37 of the shaped wire in a fashion such that the friction between the shaped wire and the hub 36 of the supply reel 7 is eliminated. This release of the supply reel 7 enables an easy unwinding of the ribbon 6 from the supply reel 7. As the tension on the ribbon 6 ceases, the movable shank 38 of the shaped wire swings immediately back to its home position, whereby the supply reel 7 is being braked again. A rotation of the supply reel 7 now being no longer possible, the ribbon 6 is held taut.

To prevent ribbon rub-off from dropping out of the longitudinal slot 25 of the base component 13 of the cartridge casing, the base component is surrounded by raised stiffening ribs 44, 45, and 46. According to FIG. 2, one stiffening rib 44 and 45 each is arranged parallel with the shifting direction of the rectangular support plate 20, on the side of the longitudinal slot 25. The ends 47, 48, 49, 50 of these stiffening ribs 44 and 45, for one, are firmly connected with the circular stiffening rib 27 and, for another, with a stiffening rib 46 which is arranged perpendicular to the direction of movement of the support plate 20. The stiffening ribs 44, 45 arranged alongside both long sides 51, 52 of the support plate 20, on the bottom 22, feature shanks 53, 54 facing one another and safely preventing a canting of the shiftable support plate 20 with the take-up reel 17; refer to FIG. 4. Also, the shank 53 features likewise a bearing face 55 for the spool 31 of the supply reel 7. Thus, the base component 13, along with the stiffening ribs 28, 29, 30, features four bearing faces for the spool 31 which are arranged at a 90° offset, thereby safely avoiding a shifting of individual layers of the spools 31.

The bottom 22 of the base component 13 of the cartridge casing also features two blind holes 56 for sound damping, two openings 57 and 58 for receiving locking elements, in the cartridge holding device of the machine, and another opening 59 for elements sensing the end of the ribbon. The spool 61 of the take-up reel 17, in the base component and on the stiffening rib 46 and on a bearing rib 60 originating from the other end of the support plate 20 and extending toward the stud 19, can be so mounted that the individual layers of the ribbon 6 will not shift relative to one another during take-up. With an extension 62, the stud 19 for the take-up reel 17 is arranged movably in a continuous longitudinal slot 63 of the cover 15 which is arranged in the direction of shift of the support plate 20, indicating the ribbon supply. The longitudinal slot 63 in the cover 15 features on the inside a surrounding collar 64 which likewise serve to support the spool 61 of the take-up reel 17.

The feed roll 65 features a spiked wheel 66 engaging the spool 61 of the take-up reel 17 and is rotatably mounted on one end 67, with a hollow stud 68, on a collar 70 surrounding an opening 69 in bottom 22 and, with its other end 71, on the inside 75 of the cover 15, with a bore 73 provided centrically in a handwheel 72, for a centering pin 74. The end face 76 of the handwheel 72 on the feed roll 62 is provided with knurling 77, with part of this end face 76 being so arranged that it can protrude out of a circular section opening 78 in the cover 15. This makes it possible to turn the feed roll 65 with the aid of the handwheel 72 and to wind the ribbon 6 on the take-up reel 17. The opening 78 in the cover 15 is located in a circular section recess 79 in the cover edge 80, in such a way that the end face 76 of the handwheel 72 will not protrude relative to the remaining surface of the cover 15. The stiffening rib 46 on the bottom 22 of the base component 13 is so designed and so arranged that the ribbon 6 rub-off accruing during take-up through the spiked wheel 66 cannot drop out of the openings 58, 59 and 25. The opening 69 is shielded against rub-off by the collar 70. These measures will safely prevent a soiling of the machine components as the cartridge 1 is used in the holder device of the machine.

The locking opening 57 in the bottom 22 of the base component 13 is shielded by a stiffening rib 81 which, for one, is firmly connected with the stiffening rib 30 and, for another, features an extension rib 82 which is arranged concentrically with the supply reel. This extension rib 82 shiftably supports the spring shank 38, rendering said shank easily movable due to slight friction.

The support plate 20 is so stressed by a spring device that the spool 61 of the take-up reel 17 is constantly held in contact with the spiked wheel 66 of the feed roll 65. This spring device consists of a shank spring 83 mounted on a stud 84 and a fixed first shank 85 and a second spring shank 86. The second shank 86 bears elastically on a shoulder 87 on the stud 19 for the take-up reel 17; refer to FIGS. 3 and 5.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims.

Having described our invention, we claim:

1. A ribbon cartridge for a typewriter or similar office machine comprising a cartridge casing having a bottom wall with openings therein, a supply reel and a take-up reel, the ribbon being carried by said reels so that it can be wound off said supply reel and rewound on said take-up reel, a driven feed roll, said cartridge casing including a cup-shaped base member, stiffening ribs protruding on the inside of the bottom wall of said base member, said take-up and supply reels being flangeless and having spools, said ribs supporting said spools and being disposed to prevent ribbon rub-off accruing in the cartridge casing from dropping out of said openings, an axle carried by said bottom wall and extending perpendicular thereto, said supply reel being rotatably mounted upon said axle, a ring-shaped bearing surface carried by said bottom wall concentric with said axle, a plurality of said stiffening ribs being disposed outside of said bearing surface and extending along radial lines from the axis of said axle, one of said stiffening ribs being a circular stiffening rib and said ring-shaped bearing surface being formed on said circular stiffening rib, a support plate, a longitudinal slot extending through the bottom wall of said base member, said support plate being shiftable in said longitudinal slot and rotationally supporting said take-up reel, a spring member attached to said supprot plate, and disposed for releasable engagement with said supply reel, said stiffening ribs being disposed about the periphery of said longitudinal slot, two of said stiffening ribs being disposed parallel with the direction of shift of said support plate, on each side of said longitudinal slot, one end of each of the two said stiffening ribs connected with said circular stiffening rib, the opposite ends of said ribs being connected with a third stiffening rib which is disposed perpendicular to the direction of movement of the support plate.

2. The cartridge of claim 1, in which the support plate carries two guide pins spaced from one another and disposed slidably in the longitudinal slot, the said two stiffening ribs disposed alongside both sides of the support plate on the bottom including shanks that face each other and prevent a canting of the shiftable support plate with the take-up reel.

3. The cartridge of claim 2, in which at least one of said shanks also provides a bearing face for the spool of the supply reel.

* * * * *